United States Patent [19]

Hartman et al.

[11] 4,434,204

[45] Feb. 28, 1984

[54] SPUN-BONDED FABRIC OF PARTIALLY DRAWN POLYPROPYLENE WITH A LOW DRAPING COEFFICIENT

[75] Inventors: Ludwig Hartman; Ivo Růzek; Engelbert Löcher, all of Kaiserslautern, Fed. Rep. of Germany

[73] Assignee: Firma Carl Freudenberg, Weinheim an der Bergstrasse, Fed. Rep. of Germany

[21] Appl. No.: 416,700

[22] Filed: Sep. 10, 1982

[30] Foreign Application Priority Data

Dec. 24, 1981 [DE] Fed. Rep. of Germany ..... 3151294

[51] Int. Cl.[3] ..... D04H 1/58

[52] U.S. Cl. ..... 428/198; 428/288; 428/289; 428/290; 428/294; 428/296

[58] Field of Search ..... 428/198, 288, 289, 290, 428/294, 296

[56] References Cited

U.S. PATENT DOCUMENTS 4,100,319 7/1978 Schwartz ..... 428/296

*Primary Examiner*—Marion McCamish

*Attorney, Agent, or Firm*—Kenyon & Kenyon

[57] ABSTRACT

The present invention provides for a soft, polypropylene spun-bonded fabric comprising continuous, i.e. endlessly spun, partially drawn polypropylene filaments which have a maximum tensile elongation of at least 200%.

6 Claims, 2 Drawing Figures

FLOW CURVE, POLYPROPYLENE

SPUN-BONDED FABRIC OF PARTIALLY DRAWN POLYPROPYLENE WITH A LOW DRAPING COEFFICIENT

FIELD OF THE INVENTION

The present invention relates to a polypropylene spunbonded fabric. More specifically, the polypropylene spun-bonded fabric of the present invention is characterized by a low draping coefficient and a particularly soft textile-like feel.

BACKGROUND OF THE INVENTION

Spun-bonded fabrics in general, as well as polypropylene spun-bonded fabrics, are known. The term spun-bonding refers to a method of making nonwoven fabrics. In the spun-bonded process, a molten synthetic polymer is forced through a spinneret or spinning nozzle which is an essential device in the production of man-made fibers. The spinning nozzle looks much like a thimble punctured at its end with holes. As the molten polymer is rapidly forced through the holes of the spinning nozzle, a fine filament is produced. The continuous filaments formed in the spun-bonding process are then laid down on a moving conveyor belt to form a continuous web, which web is then bonded by thermal or chemical means.

Nonwoven fabrics produced by spun-bonding have good textile-like properties, although not always comparable to woven or knit materials, especially with regard to feel. It is an object of the present invention to provide a method for manufacturing spun-bonded fabrics that are "textile-like", i.e., soft and adaptable and marked by a very low draping coefficient.

SUMMARY OF THE INVENTION

The present invention provides for a soft, polypropylene spun-bonded fabric comprising continuous, i.e. endlessly spun, partially drawn polypropylene filaments which have a maximum tensile elongation of at least 200%.

DETAILED DESCRIPTION OF THE INVENTION

Figure 1:
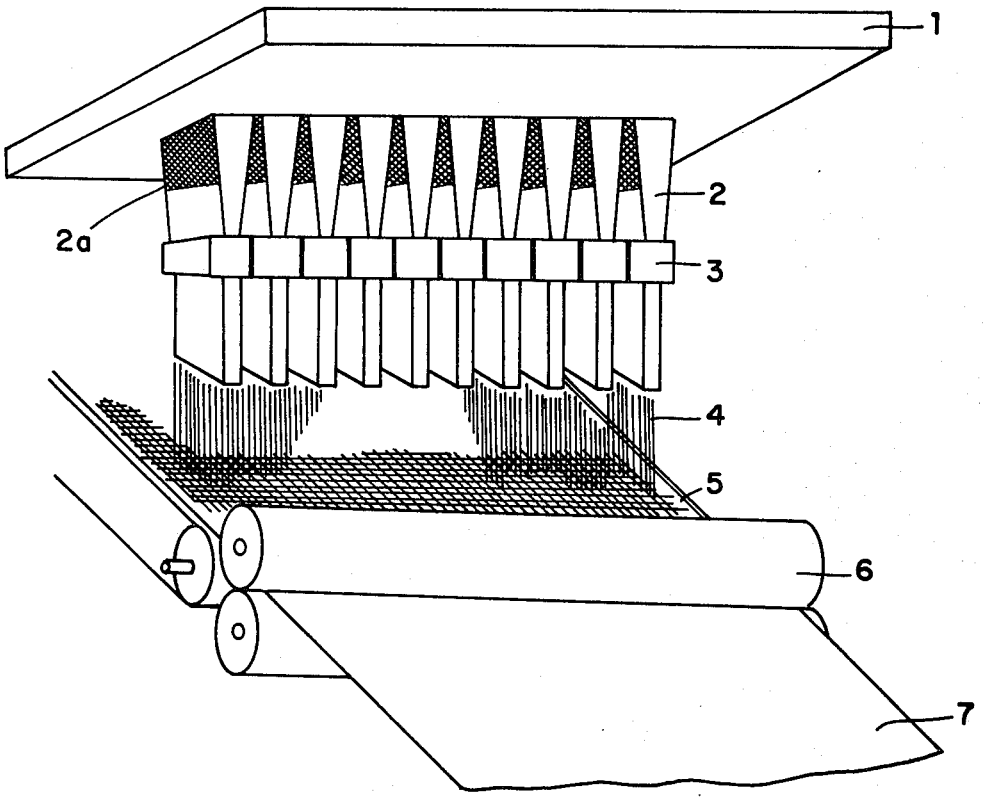
FIG. 1 is a representation of a device by which to produce the spun-bonded polypropylene fabrics according to the present invention.

It is known that the fibers or filaments forming a nonwoven fabric of high quality, must have high molecular orientation, i.e., the drawing ratio must be high enough. The purpose of orientation in the manufacture of synthetic fiber materials is the alignment of the macro-molecular chains in the direction of the longitudinal fiber axis, to increase the fiber's strength and to reduce the ultimate elongation. Many scientific methods are known by which the degree of orientation may be measured. For example, anisotropy may be measured by optical or acoustical means or by evaluation of X-ray scatter diagrams. Of course, as the degree of orientation, resulting from the drawing of the fibers, is related to the fibers' strength, it often is sufficient to differentiate between fibers and fiber products by determining the strength parameters of the fibers, such as tensile strength and maximum tensile elongation. For example, fibers to be used for technical purposes, with an appropriately high orientation of the fiber, may have a maximum tensile elongation value of less than 10%. In contrast, ordinary fibers and filaments for textile applications may be differentiated in that they may have maximum tensile elongation values of up to about 60%.

Drawn, as well a partially drawn or undrawn, fibers are used in the manufacture of nonwoven fabrics. While the drawn or highly oriented fibers comprise the actual fabric forming fibers, the partially drawn or undrawn fibers are commonly used only as bonding fibers.

Contrary to such conventional nonwoven fabrics, the polypropylene spun-bonded fabric according to the present invention is comprised of partially drawn polypropylene filaments as the fabric-forming fibers. Surprisingly, it has been found that the non-woven fabrics of the present invention not only have great strength in use, but also simultaneously exhibit a very soft, textile-like feel. Such properties are especially desirable in non-woven fabrics made for use in medical or hygiene articles. These novel properties are also very advantageous in so-called "composite planar structures", which comprise several layers of soft, non-woven fabric materials.

The good textile-like properties of nonwovens produced according to the present invention are particularly unexpected and surprising because the partially drawn fibers used have a limp feel in their unprocessed condition, and it would not be expected that such "limp" fibers would result in a soft but very strong nonwoven fabric having excellent drapability. Another advantage of the present invention relates to the bonding step, after the polypropylene filaments have been laid down on a conveyor belt typically used in spun-bonding. Excellent bonding can be effected by, for example, employing a calender embossing technique. By using a suitable calender embossing technique, it is not necessary to simultaneously employ bonding agents or extraneous bonding fibers. Also, in comparison to articles comprising fully drawn fibers, the partially-drawn nonwovens of the present invention can be bonded by a calender embossing technique which employs substantially gentler pressure and temperature conditions.

The soft, textile-like properties of the spun-bonded fabrics according to the present invention are the reason for the fabrics' good drapability. Drapability is determined in accordance with German Industrial Standard-DIN 54306, which is incorporated herein by reference. Drapability determined according to DIN 54306 is related to the degree of deformation observed when a horizontally lying planar structure, subject only to the forces resulting from its own weight, is allowed to hang over the edge of a support plate.

Drapability, measured in accordance with DIN 54306, is characterized in terms of the draping coefficient D, and is expressed as a percentage. Of course, the draping coefficient of the presently disclosed polypropylene spun-bonded fabrics is a critical parameter. The lower D is, the better drapability is, and consequently the feel of the planar structure is better. Thus nonwoven fabric materials in accordance with the present invention are characterized by a draping coefficient determined according to DIN 54306, which satisfies the following equation:

$$D \leqq 1.65FG + 30(\%)$$

wherein (FG) is the area weight of the particular material. Materials having a D value greater than that satisfying the equation above are considered too hard in the context of the present invention, although such materials are textile-like.

Conventional fully drawn fibers used for the manufacture of nonwoven fabrics have maximum tensile elongation values of less than 100% of their original length, as measured in accordance with DIN 53857, which is incorporated herein by reference. The term maximum tensile elongation, as employed herein, refers to maximum tensile elongation values determined in accordance with DIN 53857. In contrast, the partially drawn fibers of the present invention may exhibit maximum tensile elongation values of at least about 200%. However, fibers having a maximum tensile elongation value of more than about 400% of their original length are particularly advantageous for use in accordance with the preparation of the spun-bonded fabrics of this invention. Those fibers are produced by adjusting the manufacturing parameters in the manner described below.

It is also important that the partially drawn fibers of the present invention be characterized by low fiber shrinkage, namely, shrinkage of less than 10% as determined in boiling water. Fibers with higher fiber shrinkage would considerably disrupt fabric manufacture. A shrunk fabric obtained from fibers having such higher shrinkage would be much too dense and hard. It follows that the manufacture of the fibers should be directed to the preservation of the partially drawn, and at the same time, low shrinkage properties of the fibers.

In order to obtain partially drawn polypropylene fibers satisfying the above-indicated parameters, i.e., high maximum tensile elongation, low draping coefficient and low shrinkage, it was found that the spinning path of the filaments being extruded from the spinning nozzle had to be shortened considerably in comparison to the spinning path in a typical spun-bonding process. As there is a shortened spinning path, i.e., shortened distance between extrusion of the filament from the spinning nozzle to its deposition on the moving conveyor belt, it is possible to accordingly set the ratio of the extrusion velocity to the withdrawal velocity of the extruded fibers so as to obtain a low deformation ratio. The deformation ratio, as will be more fully described below, is the ratio between the extrusion velocity, and the withdrawal velocity of the extruded fibers.

FIG. 1 is a representation of a device by which to produce the partially drawn polypropylene filaments with low shrinkage, in accordance with the present invention.

There is provided a spinning beam (1) to accommodate the heatable spinning nozzles. The spun filaments which are extruded from the spinning nozzles are cooled down in cooling wells (2), by virtue of air being drawn in through openings (2*a*) covered with screens. The filaments are subsequently partially drawn by virtue of their being subjected to the ejection action of withdrawal canals (3).

The present invention preferably involves the use of aerodynamic means for drawing the extruded filaments. Suitable aerodynamic withdrawing elements are of course known in the spun-bonding art. Although the energy required to create the air flow suitable to draw the filaments, compares unfavorably to the energy required for known mechanical drawing systems, this air flow energy is reduced to a minimum by virtue of the fact that a shortened spinning path is utilized in accordance with this invention.

After the partially drawn groups of filaments (4) leave the withdrawal canals (3), they are deposited on a moving screen belt (5) to form a web. Deposition is aided by the action of a vacuum creating suction from below the screen. The web so formed is then bonded or solidified by the action of calender means (6). The finished nonwoven fabric web (7) is then rolled up.

The spinning operation, i.e., the operation of extruding a molten polymer through a spinning nozzle, takes place at polypropylene melt temperatures of 240° C. to 280° C. The spinning nozzles have a multiplicity of holes, the diameter of which is less than about 0.8 mm, e.g., about 0.4 mm. The gear pump used to force the molten polymer through the spinning nozzle is suitably set so as to produce extrusion velocities of from about 0.02 meters/second (m/s) to about 0.2 m/s. The filaments so formed are guided through a free distance of at most about 0.8 m, whereupon they enter an aerodynamic withdrawal element comprising the cooling wells and withdrawal canals.

The filaments are cooled by being transversely blasted by air at a temperature of about 20° C. to about 40° C., which air is drawn in through the screened sides of the cooling wells (2) as a result of the injector effect of the aerodynamic means used to draw the filaments. Installation of screens into the walls of the cooling wells also allows for equalization of the transverse air flow created. The suction action created by the aerodynamic withdrawal element should be adjusted so that there is a filament withdrawal velocity of about 20 m/s to 60 m/s. Appropriate withdrawal velocity may be determined by consideration of the filament diameter and the continuity equation. For constant extrusion conditions, the spinning process can be controlled by the fiber diameter. The filament diameter permits determination of a range for the deformation ratio. The deformation ratio is defined as the ratio of the extrusion velocity to the withdrawal velocity, which should be about 1:200 to 1:1000. The filaments may suitably have a filament titer of about 2.5 to about 4.0 dtex, a maximum fiber tensile strength of about 10 to about 14 N/dtex and a maximum fiber tensile elongation of about 450 to about 500%.

As mentioned earlier, the drawn filaments exiting from the withdrawal canals ultimately are deposited on a porous movable support or screen belt, aided by a suction action which is created below the support.

Figure 2:
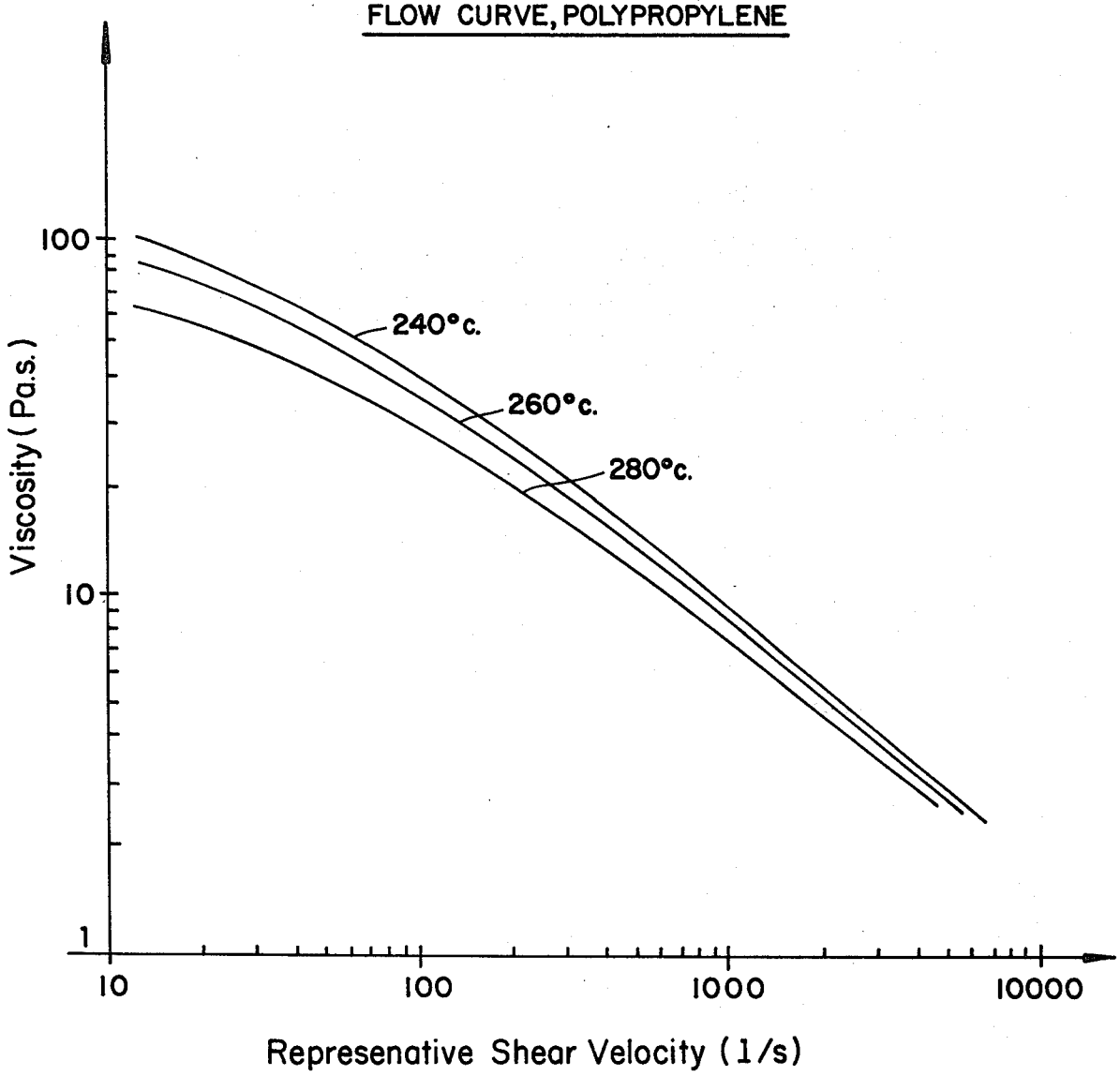
FIG. 2 graphically represents the change in melt viscosity of polypropylene, as a function of melting temperature and shear velocity.

Atactic polypropylene may be employed. In addition, polypropylene having a particularly narrow weight distribution is advantageously employed in accordance with this invention. Such a weight distribution can be achieved by, for example, breaking down polypropylene and regranulating it. Polypropylene having the desired weight distribution is characterized by a special relationship between its melt viscosity as a function of shear velocity. In accordance with the present invention, it is stipulated that at a melting temperature of 280° C. and for a representative shear velocity of 362 l/s, the melt viscosity of desirable polypropylene will be in the range of about 45 (pascal seconds) Pa.s±3%; while for a shear velocity of 3600 l/s, the melt viscosity is in the range of about 14 pa.s±2%; and finally for a shear velocity of 14,480 l/s, the melt viscosity is in the range of about 6 pa.s±1.5%. FIG. 2 more clearly represetns the change in melt viscosity of the polypropylene as a function of variation in shear velocity. Three melt temperatures are shown—240° C., 260° C. and 280° C.

To produce the soft feel and other properties of the presently disclosed nonwoven fabrics, it is preferred that the fabric be formed on the moving screen belt such that the filament withdrawal velocity effectuated by the aerodynamic withdrawal elements is about ten to twenty times that of the velocity of the moving belt. Fabric structure may also be preferably improved by utilizing suitable means to produce an oscillating motion in the groups of filaments exiting from the aerodynamic withdrawal elements. This oscillation represents a third kinematic component of fabric formation. The velocity vector acting transversely to the fabric travel direction should be about 0 to 2 times the fabric travel velocity.

In order to produce a nonwoven fabric having properties consistent with those herein disclosed, (such as suitable density, and desirable gas and liquid permeability) it is preferred that the finished fabric not be characterized exclusively by individual filaments. Rather, it is preferred that the component filaments be partially combined to form alternating groups or light bundles of about 2 to 5 filaments. Such bundles can be easily formed by suitably adjusting the internal cross-sectional area of the aerodynamic withdrawal element in relation to the number of fibers running through it. The device described in German Pat. No. 1560801 which is incorporated herein by reference, also provides one option for controlling such bundle formation. When the filaments or bundles of filaments are deposited without preferred direction, i.e., in a random manner, the web so formed will naturally have a crossed parallel texture.

The nonwoven fabric web formed on the moving belt is bonded, or solidified, in a calender gap which consists of a smooth and an engraved cylinder. For purposes of the present invention, the temperature in the calender gap should be from about 130° C. to 160° C. Furthermore, only moderate line pressure is required, viz. about 40 N/cm width to 500 N/cm width.

For some applications, it is necessary to adjust the surface tension of the fabric material which consists of hydrophobic polypropylene fibers, to a surface tension of $35\times10^{-5}$ N/cm by applications of a suitable wetting agent so that the fabric is rendered wettable with aqueous and polar liquids.

The following example more fully describes the manufacture of a polypropylene spun-bonded fabric, in accordance with at least one embodiment of the present invention.

EXAMPLE

A spinning facility with two spinning stations was used. A polypropylene granulate was used which had viscosity characteristics consistent with the curve represented in FIG. 2. As discussed, FIG. 2 is a graphic representation of the melt viscosity of polypropylene as a function of shear velocity and melt temperature.

The polypropylene granulate was melted in an extruder to produce a melt with a temperature of 270° C. This melt was fed to the spinning stations, each station had a spinning pump and a nozzle block. The spinning plates had selectably, 600 and 1000 holes, each hole having a diameter of 0.4 mm. The freshly spun filaments extruded from these holes were blasted with cool air at a point underneath the spinning nozzle. The cooling section was 0.4 m long. The cooled filaments were then seized by an air stream in order to draw them.

After exiting from the withdrawal element, the bundles of filaments were subjected to an oscillating force, and then deposited on a screen belt that had a vacuum below it creating suction, to form a random fabric.

The various parameters of the above-described process are tabulated in Table 1, below. The fiber or filaments produced during the process are partially drawn of course. The fibers are more fully described by the parameters tabulated in Table 2.

The fabric web formed on the screen belt was bonded in a calender gap, characterized by cylinders set at a temperature of 160° C. and a line pressure to a value of 120 N/cm width. As discussed earlier, the gap consists of a smooth and engraved cylinder. The engraved cylinder had 500,000 rectangular dots per square meter, with a side length of 0.7 mm each.

Finished nonwoven fabrics having area weights of 10, 15, 20 and 30 g/m$^2$, were produced by the process described above. Other parameters of these fabrics are tabulated in Table 3.

Part of at least one of the fabrics formed was finished in a bath containing a nonionic surfactant wetting agent, at a concentration of 10 g surfactant/liter. The treated fabric was dried, and when subjected to a test with water, having been adjusted to a surface tension of $35\times10^{-5}$ N/cm, perfect wettability was observed.

TABLE 1

| Spinning Parameters | |
|---|---|
| Melt temperature | 270° C. |
| Melt pressure | 20 bar |
| Throughput per hole | 0.5 g/min |
| Hole diameter | 0.4 mm |
| Cooling section | 0.4 m |
| Flow velocity of the pulling-off air | 30 m/s |
| Inside cross-section of withdrawing canal | 120 cm$^2$ |
| Temperature of the pulling-off air | 30° C. |
| Temperature of the engraved calender cylinder | 150° C. |
| Calender line pressure | 120 N/cm |

TABLE 2

| Fiber Data | |
|---|---|
| Filament titer | 2.5 to 4 dtex |
| Maximum tensile strength | 10 to 14 N/dtex |
| Maximum tensile elongation | 450 to 500% |

TABLE 3

| Nonwoven Fabric Data | | | | |
|---|---|---|---|---|
| Test | A | B | C | D |
| Area weight (g/m$^2$)* | 10 | 15 | 20 | 30 |
| Fabric thickness (mm) | 0.13 | 0.16 | 0.22 | 0.28 |
| Number of spot welds per cm$^2$ | 50 | 50 | 50 | 50 |
| Maximum tensile strength (N) | | | | |
| longitudinally | 15 | 25 | 33 | 60 |
| transversely | 15 | 25 | 32 | 50 |
| Maximum tensile elongation (%) | | | | |
| longitudinally | 80 | 70 | 81 | 67 |
| transversely | 80 | 65 | 85 | 71 |
| Tear propagation strength (N) | | | | |
| longitudinally | 5.5 | 6.5 | 11.0 | 13.0 |
| transversely | 5.5 | 6.5 | 10.5 | 13.0 |
| Draping coefficient (DIN5430) (%) | 40.7 | 47.2 | 61.5 | 74.1 |

*Fabrics made in accordance with the present invention will preferably have an area weight between about 5 and about 50 g/m$^2$.

The invention has been described in terms of specific embodiments set forth in detail, but it should be understood that these are by way of illustration only, and that the invention is not necessarily limited thereto. Modifications and variations will be apparent from this disclosure and may be resorted to without departing from the spirit of this invention, as those skilled in this art will readily understand. Accordingly, such variations and modifications are considered to be within the purview and scope of this invention and the following claims.

We claim:

1. A spun-bonded fabric having a low draping coefficient, said fabric being comprised of polypropylene fibers which are endlessly spun in the form of a spun-bonded fabers, wherein the polypropylene fibers which comprise said fabric are partially drawn, have a maximum tensile elongation of at least about 200%, and have a fiber shrinkage determined in boiling water of less than about 10%.

2. A spun-bonded fabric according to claim 1 wherein the filaments have a maximum tensile elongation of at least about 400%.

3. A spun-bonded fabric according to claim 1 wherein the fabric is characterized by a crossed paralled texture.

4. A spun-bonded fabric according to claim 1, wherein the draping coefficient (D) satisfies the equation:

$$D \leqq 1.65FG + 30(\%)$$

wherein (FG) is the area weight of the particular material.

5. A spun-bonded fabric according to claim 1 or 4, wherein the weight per unit area of the fabric is between about 5 to about 50 g/m$^2$.

6. A spun-bonded fabric according to claim 1 to which a surfactant has been applied to provide said fabric with a surface tension of about $35 \times 10^{-5}$ N/cm.

* * * * *